US010561225B2

(12) United States Patent
Parekh

(10) Patent No.: US 10,561,225 B2
(45) Date of Patent: Feb. 18, 2020

(54) ADAPTABLE BACKPACK

(71) Applicant: Naina Parekh, Mumbai (IN)

(72) Inventor: Naina Parekh, Mumbai (IN)

( * ) Notice: Subject to any disclaimer, the term of this patent is extended or adjusted under 35 U.S.C. 154(b) by 0 days.

(21) Appl. No.: 16/204,046

(22) Filed: Nov. 29, 2018

(65) Prior Publication Data

US 2019/0343266 A1 Nov. 14, 2019

Related U.S. Application Data

(60) Provisional application No. 62/680,960, filed on Jun. 5, 2018.

(30) Foreign Application Priority Data

May 11, 2018 (IN) ..... 201821017763

(51) Int. Cl.
*A45F 3/04* (2006.01)
*A61H 7/00* (2006.01)
*A45F 3/00* (2006.01)

(52) U.S. Cl.
CPC ..... *A45F 3/047* (2013.01); *A61H 7/00* (2013.01); *A45F 2003/003* (2013.01); *A61H 2201/0107* (2013.01); *A61H 2201/0119* (2013.01); *A61H 2201/0157* (2013.01); *A61H 2201/1207* (2013.01); *A61H 2205/081* (2013.01)

(58) Field of Classification Search
CPC ..... A45F 2003/122; A45F 3/047; A45F 3/04; A45F 2003/125; A45F 2003/003; A45F 3/08; A61H 2201/165; A61H 2205/081
USPC ..... 224/642, 644, 645, 634, 628, 631–632
See application file for complete search history.

(56) References Cited

U.S. PATENT DOCUMENTS 5,586,705 A * 12/1996 Leonard ..... A45F 3/047 224/627
5,730,347 A * 3/1998 Finot ..... A45F 3/047 224/628
6,626,341 B2 * 9/2003 Mitchell ..... A45F 3/04 224/576
8,225,974 B2 * 7/2012 Zheng ..... A45C 15/00 224/628
2004/0134955 A1 * 7/2004 Williams ..... A45F 3/04 224/644
2006/0113343 A1 * 6/2006 Chang ..... A45F 3/12 224/576

(Continued)

*Primary Examiner* — Adam J Waggenspack
(74) *Attorney, Agent, or Firm* — Arc IP Law, PC; Joseph J. Mayo

(57) ABSTRACT

An adaptable backpack (1000) comprising a housing (100), a first comfort plate (200) and a second comfort plate (300). The first comfort plate (200) is having at least one detachable massaging unit (210) and is configured to couple with a pair of opposed extremities (120*a*) of a back surface (120) of the housing (100) thereby configuring an enclosure. The second comfort plate (300) is disposed within the enclosure such that a portion of the second comfort plate (300) extends through the first comfort plate (200) at the opposed extremities (120*b*). The second comfort (300) plate is having at least one detachable massaging unit (310) and at least one length adaptable member (330) which is configured to control movement of the second comfort plate (300) along a longitudinal direction within the enclosure. A method of adjusting the detachable massaging units (210, 310) of the adaptable backpack (1000) is also provided.

11 Claims, 6 Drawing Sheets

(56) References Cited

U.S. PATENT DOCUMENTS

| | | | | |
|---|---|---|---|---|
| 2007/0075109 | A1* | 4/2007 | McCrae | A45C 15/00 224/576 |
| 2017/0196345 | A1* | 7/2017 | Meyer | A45F 3/04 |
| 2018/0220779 | A1* | 8/2018 | Rogers | A45F 3/047 |
| 2018/0255910 | A1* | 9/2018 | Tiblas | A45F 3/047 |
| 2019/0191855 | A1* | 6/2019 | Hong | A45F 3/04 |

* cited by examiner

ADAPTABLE BACKPACK

This application claims the benefit of Indian Patent Application No. 201821017763, filed 11 May 2018, and of U.S. Provisional Application No. 62/680,960, filed 5 Jun 2018, the specifications of which are hereby incorporated herein by reference.

BACKGROUND OF THE INVENTION

Field of the Invention

The present invention generally relates to backpacks. More particularly, the present invention relates to an adaptable backpack which provides massaging effect to a user by way of one or more moveably adjusted detachable massaging units as per the height or desire of the user.

Description of the Related Art

A backpack, also known as a rucksack, is a cloth sack that is carried on a user's back and usually secured with two straps that go over the shoulders of the user. The backpacks are commonly used by hikers, frequent travelers and students for conveniently carrying various items. Further, the backpacks are often preferred over handbags for carrying heavy loads or carrying any sort of equipment, because of the limited capacity of the user to carry heavy loads for long hours, in hands. However, carrying the heavy backpacks for long hours such as while travelling, may cause the user to experience fatigue, discomfort and pain in the back due to the abnormal blood flow caused by carrying the heavy backpacks.

Back pain is among the most common reasons for people to seek medical treatment. The treatments for back pain can vary from stretches to surgery and may also require expensive body massages. Some of the conventional backpacks are designed in such a way that equally distributes the weight of the backpacks and their contents across the user's back. While these backpacks provide a measure of relief, there is no provision to provide relief to the user once the user's back begins to experience pain in both upper and lower back. Other conventional backpacks include thermal gradient pads or heating apparatus and vibration generation means or vibrating apparatus for providing relief in the user's back.

There are a number of problems associated with the conventional backpacks. The conventional backpacks do not provide any mechanism for reducing back tightness and discomfort experienced by the user. Further, in some of the conventional backpacks the user cannot simultaneously use both heating apparatus and vibration generation means to alleviate back stiffness and/or discomfort. Furthermore, some of the conventional backpacks are not designed to carry other items apart from massaging apparatus which are used for stimulating the user's back. Also, the conventional backpacks do not provide any mechanism, which can be adjusted or adapted as per the requirement of the user to reduce the pain in both upper as well as lower back.

Therefore, in view of the above limitations of the conventional approaches, assemblies/backpacks and methods, there exists a need to develop an improved approach, assembly/backpack and method which would in turn address a variety of issues including, but not limited to, back tightness or discomfort both in the upper as well as lower back, shoulder pain and which improves the capacity of the user to endure longer hours in an urban or travel scenario.

Moreover, it is desired to develop an adaptable backpack which can be adjusted as per the user's height or desire in order to provide maximum comfort to the user by providing massaging effect.

Thus, the above-described deficiencies of conventional approaches, assemblies/backpacks and methods thereof, are merely intended to provide an overview of some of the problems of conventional approaches and are not intended to be exhaustive. Other problems with conventional approaches, assemblies/backpacks and methods and their corresponding benefits of the various non-limiting embodiments described herein may become further apparent upon review of the following description.

BRIEF SUMMARY OF THE INVENTION

The following presents a simplified summary of the invention to provide a basic understanding of some aspects of the invention. This summary is not an extensive overview of the present invention. It is not intended to identify the key/critical elements of the invention or to delineate the scope of the invention. Its sole purpose is to present some concept of the invention in a simplified form as a prelude to a more detailed description of the invention presented later.

It is, therefore, an object of the present invention to provide an adaptable backpack for providing massaging effect to a user by way of movably adjusted detachable massaging units. The adaptable backpack in view of the foregoing disadvantages inherent in the prior-art, the general purpose of the present invention is to provide an adaptable backpack that is capable of including all advantages of the prior art and also overcomes the drawbacks inherent in the prior art offering some added advantages.

It is another object of the present invention to provide an adaptable backpack having one or more detachable massaging units which can be movably adjusted as per the user's height or desire.

It is another object of the present invention to provide an adaptable backpack which provides comfort to the user at upper as well as lower back or thoracolumbar region simultaneously by massaging effect and also improves blood circulation in the back.

It is still another object of the present invention to provide an adaptable backpack which improves the capacity of the user to endure longer hours in an urban or travel scenario.

Accordingly, in an aspect, the present invention provides an adaptable backpack comprising a housing, a first comfort plate and a second comfort plate. The housing is having a front surface, a back surface, a pair of opposed side surfaces, a top surface and a bottom surface. The back surface is having at least two pairs of opposed extremities. The first comfort plate is detachably coupled with the pair of opposed extremities of the back surface thereby forming openings towards other pair of opposed extremities and thereby configuring an enclosure. Further, the first comfort plate is having at least one detachable massaging unit. The second comfort plate is disposed within the enclosure such that a portion of the second comfort plate extends through the first comfort plate at the opposed extremities. Further, the second comfort plate is having at least one detachable massaging unit; a pair of straps and at least one length adaptable member. Each of the straps is coupled with the upper portion of the second comfort plate at one end and a bottom portion of the back surface of the housing at other end. Furthermore, at least one length adaptable member is coupled with a lower portion of the second comfort plate and configured to control movement of the second comfort plate along a longitudinal direction within the enclosure configured by the first comfort plate.

Accordingly, in another aspect, the present invention provides a method of adjusting the at least one detachable massaging unit of the adaptable backpack.

Other aspects, advantages, and salient features of the invention will become apparent to those skilled in the art from the following detailed description, which, details the invention in different embodiments.

BRIEF DESCRIPTION OF THE DRAWINGS

While the specification concludes with claims that particularly point out and distinctly claim the invention, it is believed that the advantages and features of the present invention will become better understood with reference to the following more detailed description of expressly disclosed exemplary embodiments taken in conjunction with the accompanying drawings. The drawings and detailed description which follow are intended to be merely illustrative of the expressly disclosed exemplary embodiments and are not intended to limit the scope of the present invention as set forth in the appended claims. In the drawings:

DETAILED DESCRIPTION OF THE INVENTION

Call Out List

1000 Adaptable backpack
- 100 Housing
  - 110 front surface
  - 120 back surface
    - 120*a* first pair of opposed extremities
    - 120*b* second pair of opposed extremities
  - 130, 140 pair of opposed side surfaces
  - 150 top surface
  - 160 bottom surface
- 200 First comfort plate
  - O, O' openings
  - 210 detachable first massaging unit
- 300 Second comfort plate
  - 310 detachable second massaging unit
  - 320 pair of straps
  - 330 length adaptable member
- 400 Control unit
- 500 Detachable power unit The exemplary embodiments described herein detail for illustrative purposes are subject to many variations in the structure and design. It should be emphasized, however, that the present invention is not limited to a particular adaptable backpack as shown and described herein. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein is for the purpose of description and should not be regarded as limiting.

The use of terms "including," "comprising," or "having" and variations thereof herein are meant to encompass the items listed thereafter and equivalents thereof as well as additional items.

Further, the terms, "an" and "a" herein do not denote a limitation of quantity, but rather denote the presence of at least one of the referenced item.

Figure 1:
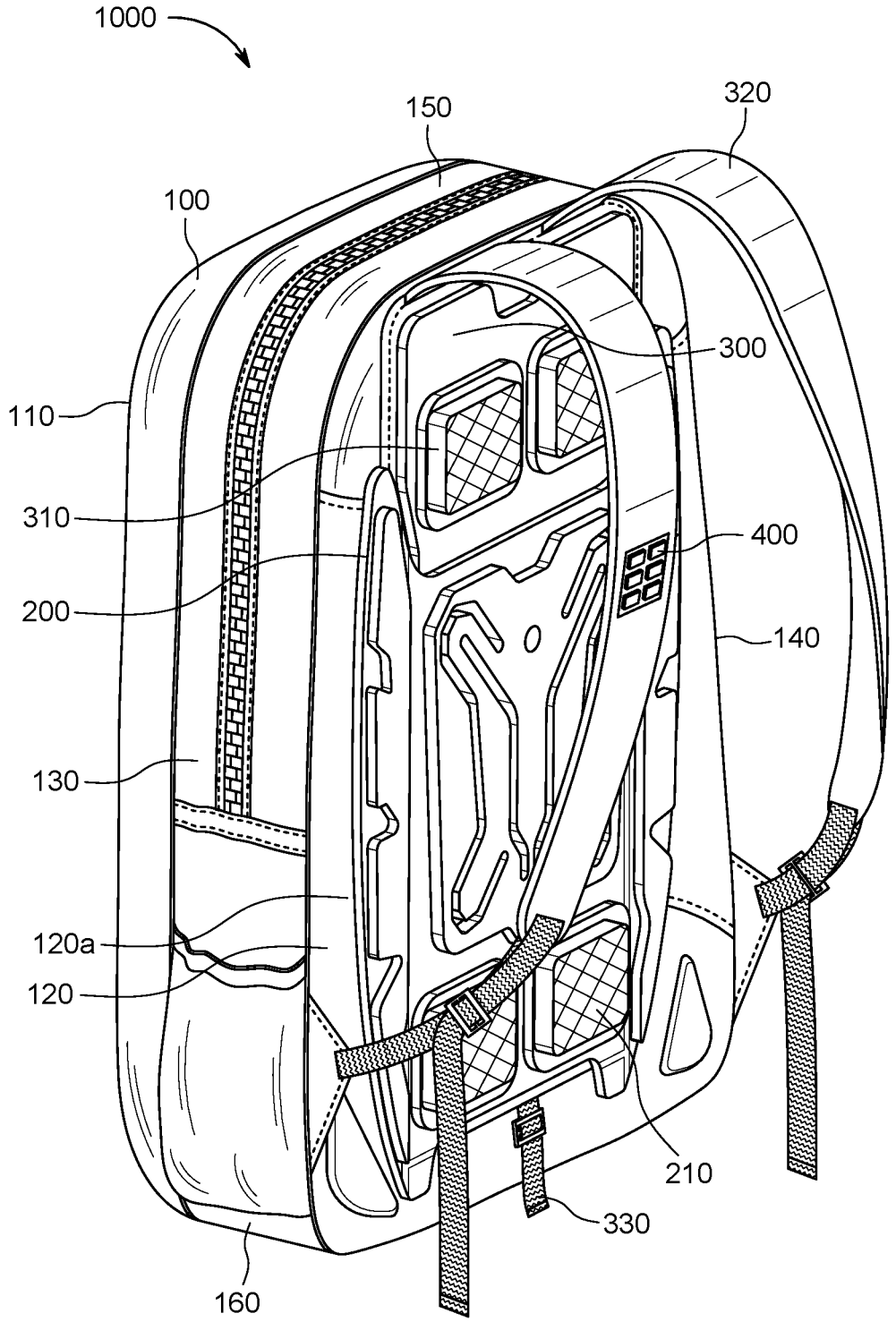
FIG. 1 illustrates a perspective view of an adaptable backpack in accordance with an embodiment of the present invention.

Referring to the drawings, the invention will now be described in more detail. An adaptable backpack (1000), as shown in FIG. 1, comprises a housing (100), a first comfort plate (200) and a second comfort plate (300). The adaptable backpack (1000) is configured to be positioned against a rear surface of a user' body and adapted to be customized to provide maximum massaging effect at upper as well as lower back or thoracolumbar region of the user based on the height or desire of the user.

In accordance with an embodiment of the present invention, the housing (100) has a front surface (110), a back surface (120), a pair of opposed side surfaces (130, 140), a top surface (150) and a bottom surface (160), as shown in FIG. 1. Further, the back surface (120) of the housing (100) is having at least two pairs of opposed extremities, namely, a first and a second pair of opposed extremities (120*a*, 120*b*).

Figure 2:
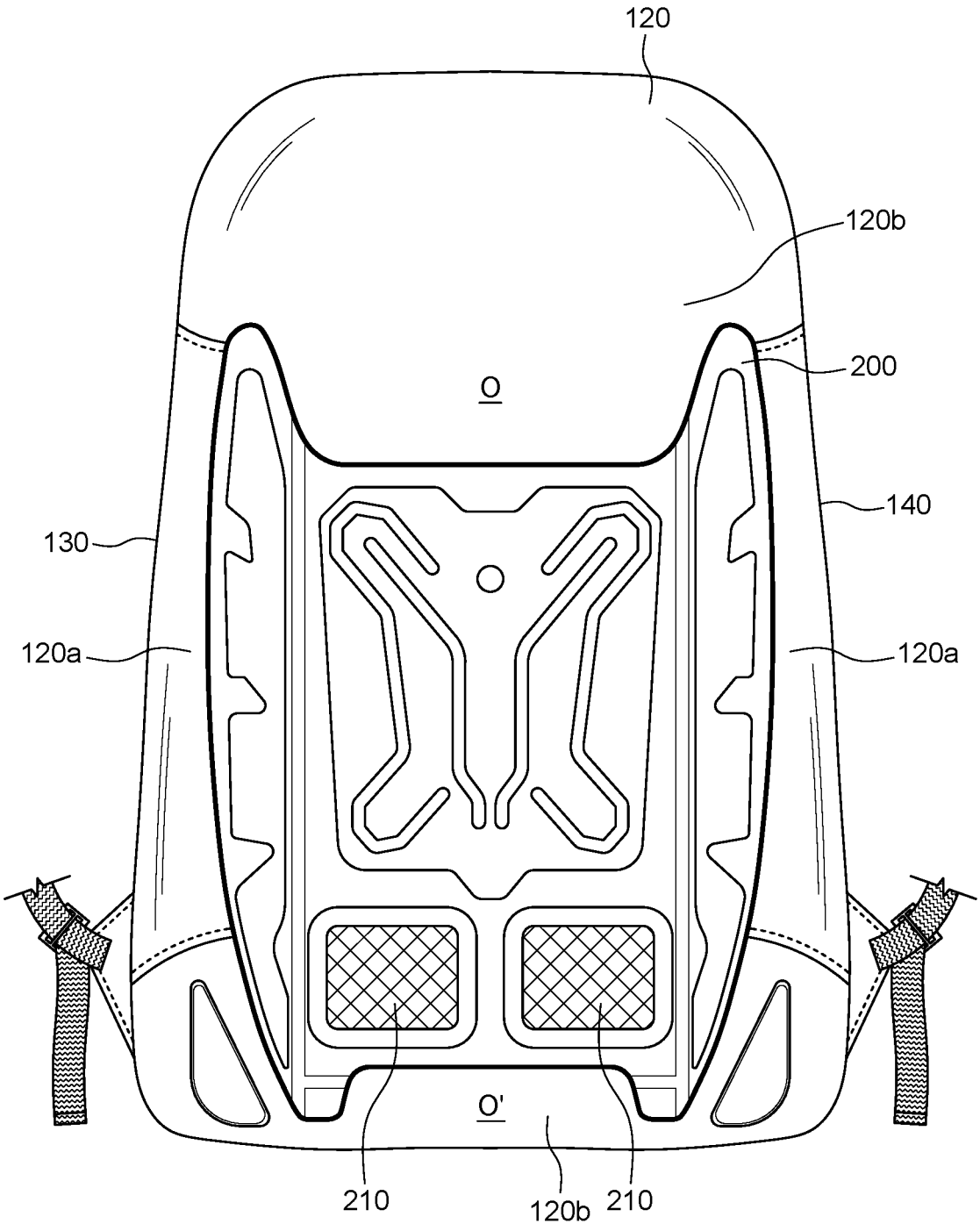
FIG. 2 illustrates a rear view of the adaptable backpack showing a first comfort plate in accordance with an embodiment of the present invention.

In accordance with an embodiment of the present invention, the first comfort plate (200), as shown in FIG. 2, is detachably coupled with the first pair of opposed extremities (120*a*) of the back surface (120) thereby forming openings (O, O') towards the second pair of opposed extremities (120*b*) which thereby configures an enclosure (not shown). In particular, the opening (O) is formed towards an upper portion of the first comfort plate (200) and the opening (O') is formed towards a lower portion of the first comfort plate (200). The openings (O, O') together forms a continuous opening towards the second pair of opposed extremities (120*b*) of the back surface (120) which thereby forms the enclosure.

In accordance with an embodiment of the present invention, the first comfort plate (200) has at least one detachable massaging unit, namely, at least one detachable first massaging unit (210) which is positioned at a lower portion of the first comfort plate (200). For example, the first comfort plate (200) may have a pair of disjoined massaging units (210) for providing massaging effect, as shown in FIG. 2. Further, the at least one detachable first massaging unit (210) of the first comfort plate (200) protrudes outward from the back surface (120) of the housing (100) with a predetermined height such that the at least one detachable first massaging unit (210) is able to massage onto the lower back or lumbar region of the user wearing the adaptable backpack (1000). The at least one detachable first massaging unit (210) of the first comfort plate (200) may have a circular, rectangular or semi-rounded surface. Preferably, the at least one detachable first massaging unit (210) of the first comfort plate (200) has a semi-rounded surface in order to maximize the massage onto the lower back or lumbar region of the user. Furthermore, the first comfort plate (200) is made up of, but not limited to, ethylene-vinyl acetate (EVA) material. The at least one detachable first massaging unit (210) may be detachably coupled to the first comfort plate (200) using the coupling techniques known in the art. These techniques are known to a person skilled in the art and therefore, have not been defined here for the sake of brevity.

In accordance with another embodiment of the present invention, the first comfort plate (200) has at least one detachable massaging unit, namely, at least one detachable first massaging unit (210) which is positioned along the entire length of the first comfort plate (200) such that the at least one detachable first massaging unit (210) is able to massage onto the thoracic region and the lumbar region of the user wearing the adaptable backpack (1000).

Figure 3:
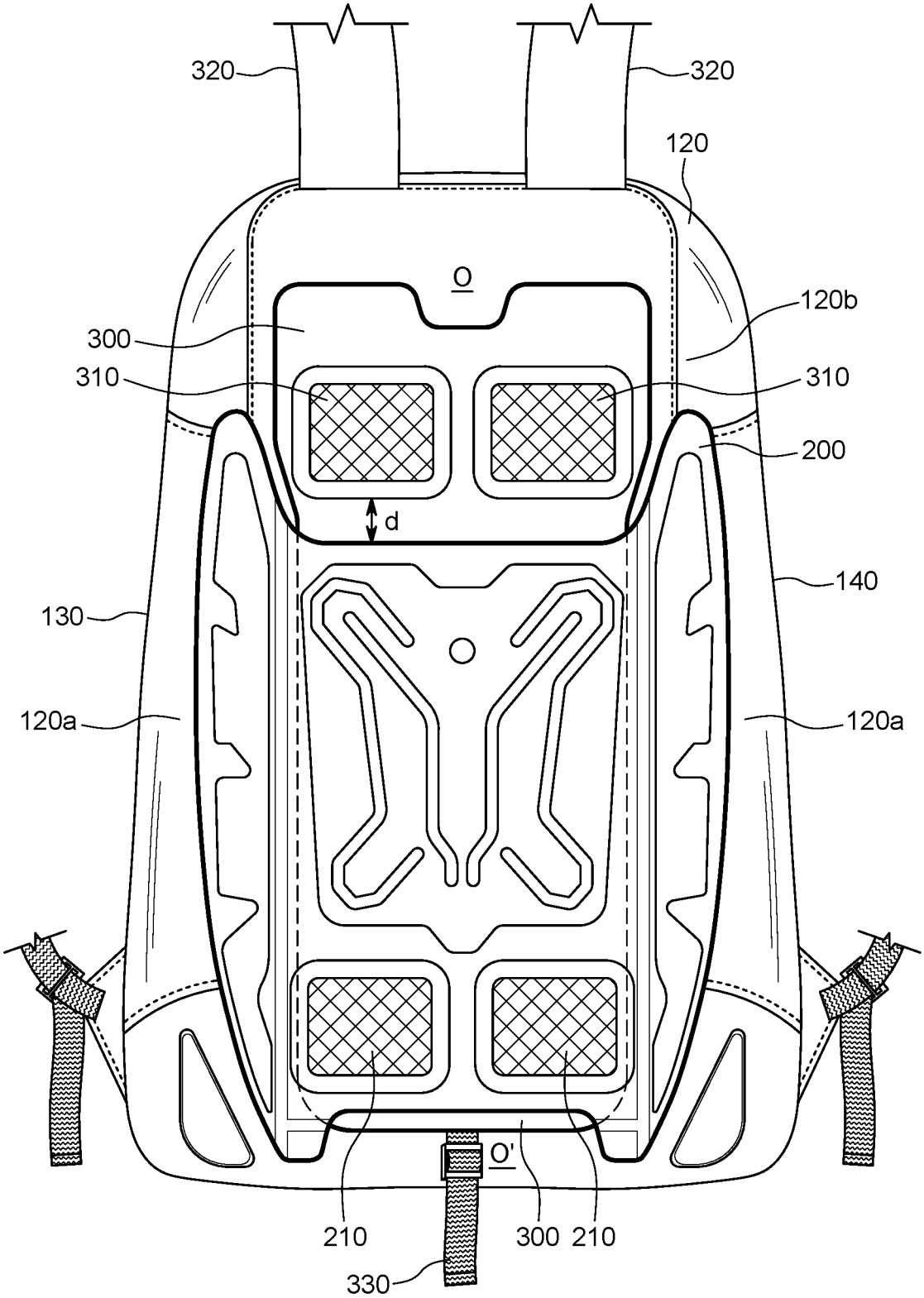
FIG. 3 illustrates the rear view of the adaptable backpack showing the first comfort plate and a second comfort plate in accordance with an embodiment of the present invention.

In accordance with an embodiment of the present invention, the second comfort plate (300) is disposed within the enclosure such that the second comfort plate (300) is well supported by the enclosure formed by the first comfort plate (200) and is moveably adjusted as per the user's height or desire. Further, the second comfort plate (300) is disposed within the enclosure such that a portion of the second comfort plate (300) extends through the first comfort plate (200) at the opposed extremities (120*b*) and through the openings (O, O'), as shown in FIG. 3. Furthermore, the second comfort plate (300) is made up of, but not limited to, ethylene-vinyl acetate (EVA) material.

In accordance with an embodiment of the present invention, the second comfort plate (300), as shown in FIG. 3, has at least one detachable massaging unit, namely, at least one detachable second massaging unit (310), a pair of straps (320) and at least one length adaptable member (330). The at least one detachable second massaging unit (310) is positioned at an upper portion (not numbered) of the second comfort plate (300). For example, the second comfort plate (300) may have a pair of disjoined massaging units (310) for providing massaging effect, as shown in FIG. 3. Further, the at least one detachable second massaging unit (310) of the second comfort plate (300) protrudes outward from the back surface (120) of the housing (100) with a predetermined height such that the at least one detachable second massaging unit (310) is able to massage onto the upper back or upper thoracic region of the user wearing the adaptable backpack (1000). The at least one detachable second massaging unit (310) of the second comfort plate (300) may have a circular, rectangular or semi-rounded surface. Preferably, the at least one detachable second massaging unit (310) of the second comfort plate (300) has a semi-rounded surface in order to maximize the massage onto the upper back or upper thoracic region of the user. The at least one detachable second massaging unit (310) may be detachably coupled to the second comfort plate (300) using the coupling techniques known in the art. These techniques are known to a person skilled in the art and therefore, have not been defined here for the sake of brevity.

In accordance with an embodiment of the present invention, the upper portion of the second comfort plate (300) may be rested upon a structure which may be coupled to the back surface (120) of the housing (100), collectively forming as the upper portion of the second comfort plate (300), as shown in FIG. 3. Further, each of the straps (320) is configured to be worn over a shoulder of the user and each of the straps (320) is coupled with the upper portion of the second comfort plate (300) and a bottom portion of the housing (100). In particular, each of the straps (320) may be coupled with the upper portion of the second comfort plate (300) and a bottom portion of the pair of opposed side surfaces (130, 140) or a bottom portion of the back surface (120) of the housing (100). Each of the straps (320) may protrude out from the structure upon which the upper portion of the second comfort plate (300) rests upon.

In accordance with an embodiment of the present invention, the at least one length adaptable member (330) is coupled with a lower portion of the second comfort plate (300) at the opening (O') and is configured to control movement of the second comfort plate (300) towards and away from the first comfort plate (200) along a longitudinal direction within the enclosure configured by the first comfort plate (200). For example, the lower portion of the second comfort plate (300) may have one length adaptable member (330) for controlling the movement of the second comfort plate (300) within the enclosure, as shown in FIG. 3.

In accordance with an embodiment of the present invention, the at least one detachable first and second massaging units (210, 310) of the first comfort plate (200) and the second comfort plate (300) are configured to operate simultaneously. In other words, the at least one detachable first and second massaging units (210, 310) of the first comfort plate (200) and the second comfort plate (300) work in combination with each other and massage simultaneously the upper and the lower back or thoracolumbar region of the user while the adaptable backpack (1000) is carried by the users. Further, the at least one detachable first and second massaging units (210, 310) of the first comfort plate (200) and the second comfort plate (300) may also work independent of each other as per the desire of the user wearing the adaptable backpack (1000).

In accordance with an embodiment of the present invention, the at least one detachable first and second massaging units (210, 310) of the first comfort plate (200) and the second comfort plate (300) may be provided as an integrated structure which is coupled with the first comfort plate (200) and the second comfort plate (300), respectively. In other words, the at least one detachable first and second massaging units (210, 310) of the first comfort plate (200) and the second comfort plate (300) are encased in a foam core for maximizing and distributing the massaging effect when the adaptable backpack (1000) is worn by the user. The foam core is then stitched all over the back surface (120) of the housing (100) with a material such as, but not limited to, neoprene fabric to cushion the effect of the at least one detachable first and second massaging units (210, 310) of the first comfort plate (200) and the second comfort plate (300).

Figure 4:
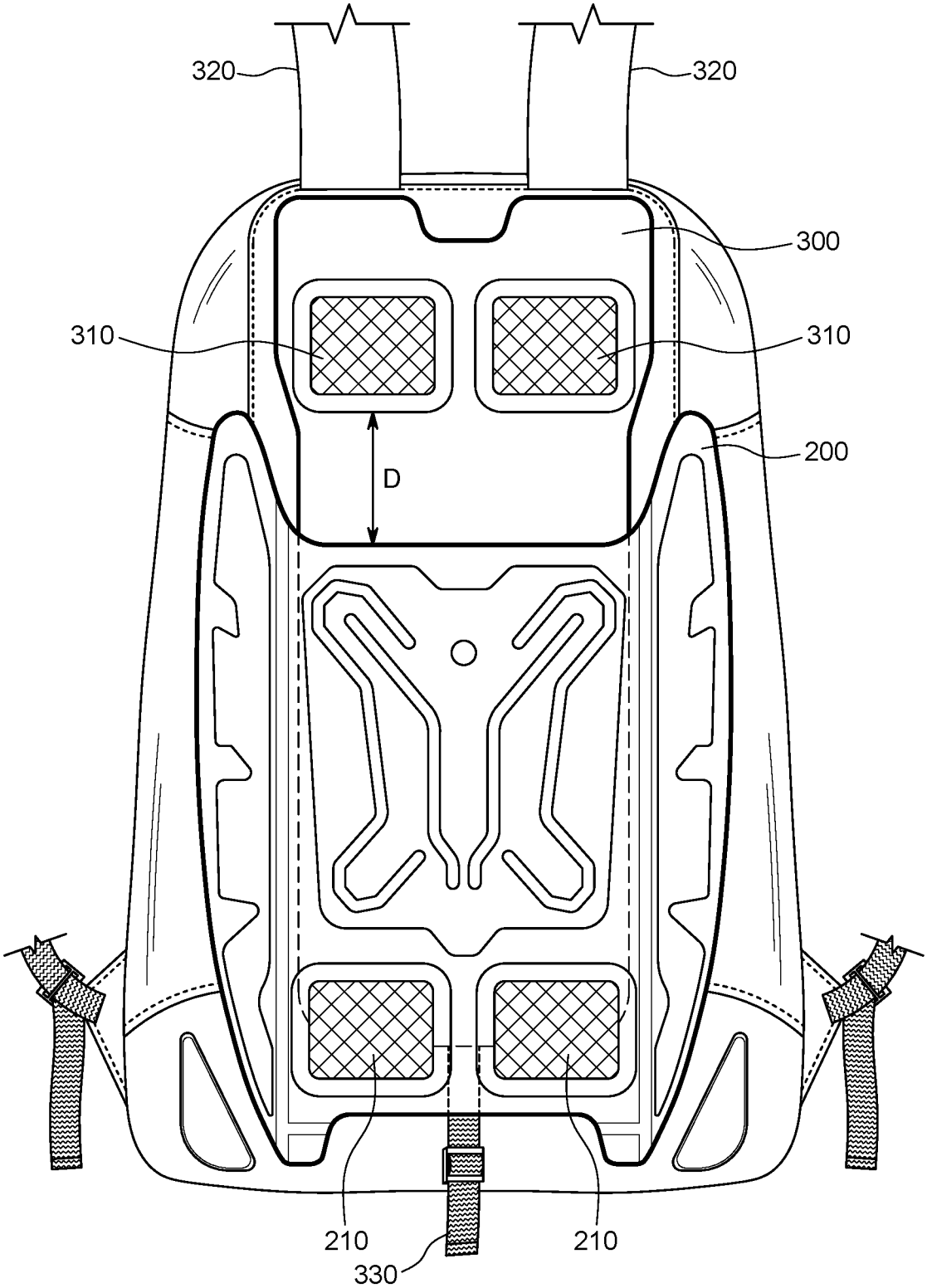
FIG. 4 illustrates the rear view of the adaptable backpack showing displacement of the second comfort plate in accordance with an embodiment of the present invention.

In accordance with an embodiment of the present invention, the at least one length adaptable member (330) facilitates in manually controlling the movement of the second comfort plate (300) within the enclosure configured by the first comfort plate (200) as per the user's height or desire, as shown in FIG. 4. This movement of the second comfort plate (300) within the enclosure aids in adjusting the placement of the at least one detachable second massaging unit (310) on the upper back or upper thoracic region of the user as per the user's height or desire. For example, as shown in FIG. 3, in a certain configuration, the placement of the second comfort plate (300) within the enclosure of the first comfort plate (200), configures a distance 'd' of the at least one detachable second massaging unit (310) from the upper portion (not numbered) of the first comfort plate (200). In an embodiment of the present invention, and as discussed above, the at least one length adaptable member (330), enables the user to change the placement/positioning of the second comfort plate (300) within the enclosure of the first comfort plate (200), for enabling the exact positioning of the at least one detachable second massaging unit (310) vis-à-vis the user's requirement. As shown in FIG. 4, the loosening of the at least one length adaptable member (330), enables the longitudinal movement of the second comfort plate (300) in respect to the first comfort plate (200), thereby configuring a distance 'D' of the at least one detachable second massaging unit (310) from the upper portion (not numbered) of the first comfort plate (200). Accordingly, the displacement of the second comfort plate (300) vis-à-vis the first comfort plate (200) would be 'D-d'. The distances 'd' and 'D' may be adjusted based on a variety of factors including, but not limited to, a user's height, desire etc. In an exemplary embodiment, the displacement 'D-d' may be 150 mm.

Figure 5C:
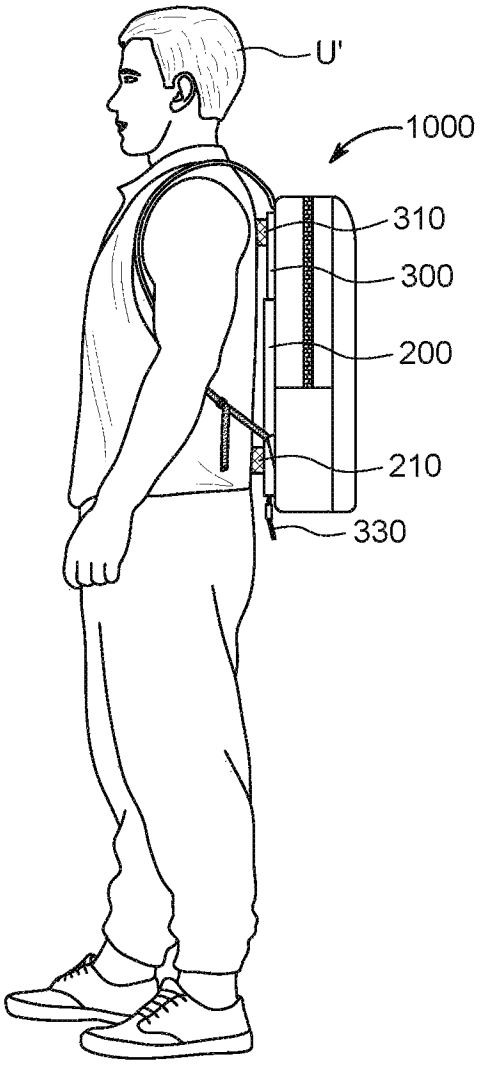
FIGS. 5A, 5B and 5C illustrate a side view of a user wearing the adaptable backpack in accordance with an embodiment of the present invention.
Figure 5B:
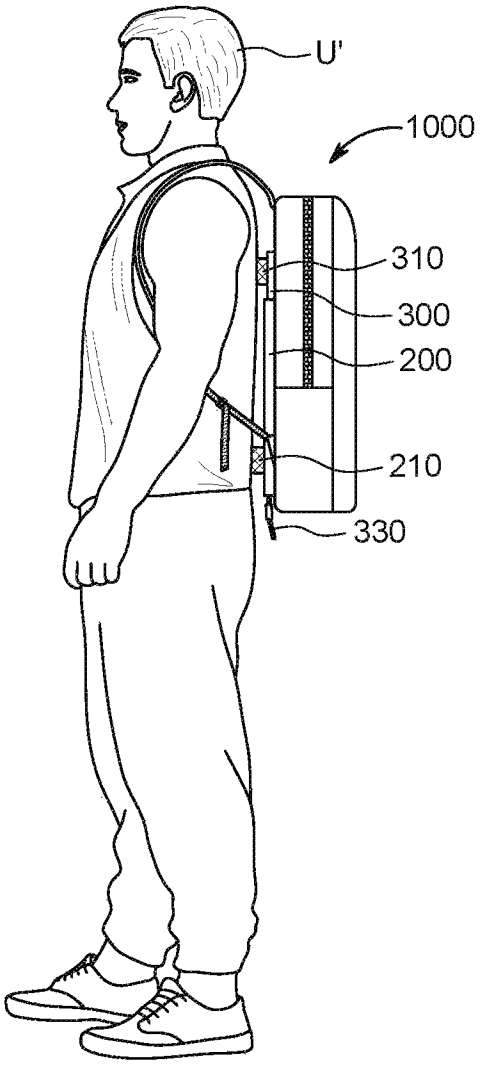
Figure 5A:
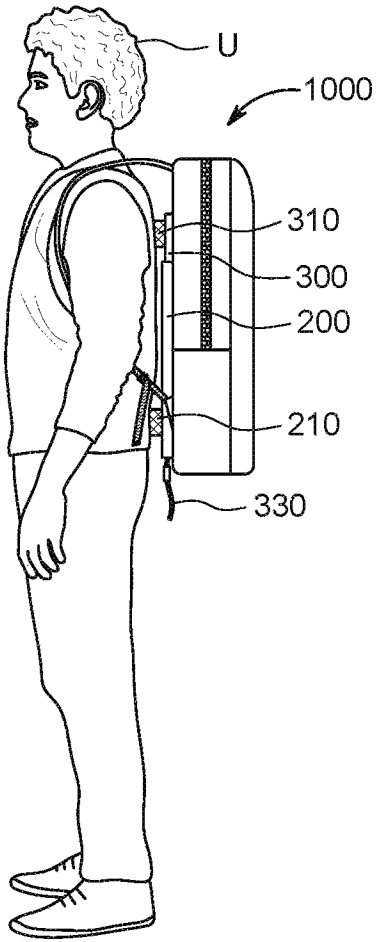

In accordance with an embodiment of the present invention, the FIGS. 5A, 5B and 5C illustrate a side view of a user wearing the adaptable backpack (1000) wherein the second comfort plate (300) along with the at least one detachable second massaging unit (310) can be adjusted as per the varying heights of the user. As shown in FIG. 5A, the second comfort plate (300) along with the at least one detachable second massaging unit (310) is adjusted as per the user (U) having short height by the at least one length adaptable member (330) such that the at least one detachable second massaging unit (310) of the second comfort plate (300) properly aligns with the upper back or upper thoracic region and the at least one detachable first massaging unit (210) of the first comfort plate (200) aligns with the lower back or lumbar region of the user (U) in order to provide maximum comfort to the user (U) while the adaptable backpack (1000) is carried by the user (U). When the adaptable backpack (1000) of this arrangement is carried by the user (U') of tall height, the at least one detachable second massaging unit (310) of the second comfort plate (300) and the at least one detachable first massaging unit (210) of the first comfort plate (200) do not align properly with the upper and the lower back or the upper thoracic region and the lumbar region of the user (U'), as shown in FIG. 5B. Further, when the second comfort plate (300) along with the at least one detachable second massaging unit (310) is adjusted again as per the height of the user (U') with tall height by the at least one length adaptable member (330), the at least one detachable second massaging unit (310) of the second comfort plate (300) properly aligns with the upper back or upper thoracic region of the user (U') of tall height and the at least one detachable first massaging unit (210) of the first comfort plate (200) properly aligns with the lower back or lumbar region, as shown in FIG. 5C.

Figure 6:
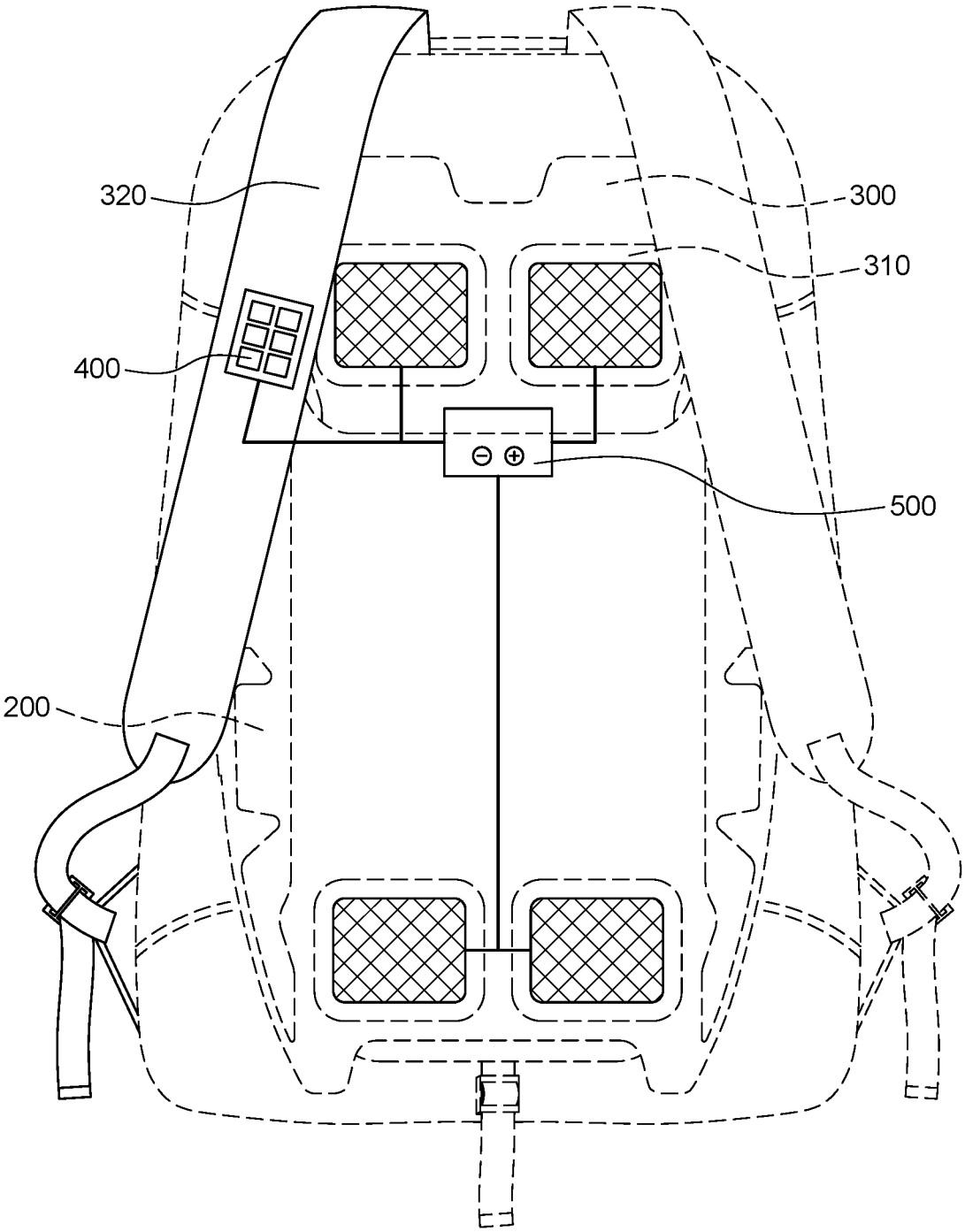
FIG. 6 illustrates the rear view of the adaptable backpack showing a control unit and a detachable power unit in accordance with an embodiment of the present invention.

In accordance with an embodiment of the present invention, the adaptable backpack (1000) further comprises a control unit (400) and a detachable power unit (500), as shown in FIG. 6. The control unit (400) is provided on at least one strap (320) of the second comfort plate (300) and is configured to control operations of the at least one detachable first and second massaging units (210, 310) of the first comfort plate (200) and the second comfort plate (300). The control unit (400) further includes an actuator for regulating the speed or intensity of the at least one detachable first and second massaging units (210, 310) of the first comfort plate (200) and the second comfort plate (300) through various power adjustments, for example low, medium and high power settings for providing varying massaging effect as per the user's requirement. Further, the at least one detachable first and second massaging units (210, 310) of the first comfort plate (200) and the second comfort plate (300) may be of same or different intensities.

In accordance with an embodiment of the present invention, the adaptable backpack (1000) may also be controlled or managed by using a wireless communication device such as, but not limited to, tablet, smart phone, laptop, netbook or any other device capable of executing the instructions. Further, the adaptable backpack (1000) may also be controlled or managed by using voice command by the user.

In accordance with an embodiment of the present invention, the detachable power unit (500) is electrically connected to the at least one detachable first and second massaging units (210, 310) of the first comfort plate (200) and the second comfort plate (300) and are powered by the detachable power unit (500). In particular, an electric motor of the at least one detachable first and second massaging units (210, 310) of the first comfort plate (200) and the second comfort plate (300) is powered by the detachable power unit (500). The detachable power unit (500) is disposed within the housing (100) of the adaptable backpack (1000). Further, the detachable power unit (500) comprises at least one replaceable battery which is also disposed within the housing (100) of the adaptable backpack (1000).

In accordance with an embodiment of the present invention, the adaptable backpack (1000) may consist of lithium ion batteries, solar cells, photocells or the like as the detachable power unit (500).

In accordance with an embodiment of the present invention, the adaptable backpack (1000) may also consist of a charging unit for charging various electronic gadgets and/or devices placed inside the adaptable backpack (1000). Further, the detachable power unit (500) and the charging unit may or may not be the same.

In accordance with an embodiment of the present invention, the adaptable backpack (1000) may be of various types including, but not limited to, laptop bag, school or college bag, rucksack, knapsack, barrel or the like.

In accordance with an embodiment of the present invention, a method of adjusting the at least one detachable massaging unit of the adaptable backpack (1000) is provided. At first step, the housing (100) of the adaptable backpack (1000) is provided. The housing (100) is having a front surface (110), a back surface (120), a pair of opposed side surfaces (130, 140), a top surface (150) and a bottom surface (160). Further, the back surface (120) of the housing (100) is having at least two pairs of opposed extremities, namely, a first and a second pair of opposed extremities (120*a*, 120*b*).

In accordance with an embodiment of the present invention, at second step of the method, the first comfort plate (200) is detachably coupled with the first pair of opposed extremities (120*a*) of the back surface (120) thereby forming openings (O, O') towards the second pair of opposed extremities (120*b*) which thereby configures an enclosure (not shown). The openings (O, O') together forms a continuous opening towards the second pair of opposed extremities (120*b*) of the back surface (120) which thereby forms the enclosure. Further, the first comfort plate (200) has at least one detachable massaging unit, namely, at least one detachable first massaging unit (210) which is positioned at a lower portion of the first comfort plate (200).

In accordance with another embodiment of the present invention, the least one detachable first massaging unit (210) is positioned along the entire length of the first comfort plate (200) such that the at least one detachable first massaging unit (210) is able to massage onto the thoracic region and the lumbar region of the user wearing the adaptable backpack (1000).

In accordance with an embodiment of the present invention, at third step of the method, the second comfort plate (300) is inserted within the enclosure such that a portion of the second comfort plate (300) extends through the first comfort plate (200) at the opposed extremities (120*b*). Further, the second comfort plate (300) has at least one detachable massaging unit, namely, at least one detachable second massaging unit (310), a pair of straps (320) and at least one length adaptable member (330). The at least one detachable second massaging unit (310) is positioned at an upper portion of the second comfort plate (300). Each of the straps (320) is coupled with the upper portion of the second comfort plate (300) and a bottom portion of the housing (100). Further, the at least one length adaptable member (330) is coupled with a lower portion of the second comfort plate (300).

In accordance with an embodiment of the present invention, at fourth step of the method, movement of the second comfort plate (300) along a longitudinal direction within the enclosure is controlled by the at least one length adaptable member (330) which thereby adjusts placement of the at least one detachable second massaging unit (310) of the second comfort plate (300) as per the height of a user.

Apart from what is disclosed above, the present invention also includes some additional benefits and advantages. Few of the additional benefits are mentioned below:

The present invention provides the adaptable backpack which facilitates the adjustment of at least one detachable massaging unit in a convenient way as per the height or desire of the user.

The adaptable backpack with movably adjusted detachable massaging units massage the upper as well as lower back or thoracolumbar region of the user creating a soothing effect and comfort to the user with heavy loads and also improves blood circulation in the back.

The detachable massaging units of the adaptable backpack maximize the massaging effect onto the back of the user by covering larger surface area on the back as compared to conventionally used point of contact massagers.

The adaptable backpack reduces back tightness and discomfort both in upper as well as lower back or thoracolumbar region of the user and thus, improves the capacity of the user to endure longer hours in an urban or travel scenario.

The foregoing descriptions of exemplary embodiments of the present invention have been presented for purposes of illustration and description. They are not intended to be exhaustive or to limit the invention to the precise forms disclosed, and obviously many modifications and variations are possible in light of the above teaching. The exemplary embodiment was chosen and described in order to best explain the principles of the invention and its practical application, to thereby enable others skilled in the art to best utilize the invention and various embodiments with various modifications as are suited to the particular use contemplated. It is understood that various omissions, substitutions of equivalents are contemplated as circumstance may suggest or render expedient, but is intended to cover the application or implementation without departing from the spirit or scope of the claims of the present invention.

What is claimed is:

1. An adaptable backpack (1000), comprising:

a housing (100) having a front surface (110), a back surface (120), a pair of opposed side surfaces (130, 140), a top surface (150) and a bottom surface (160), said back surface (120) having at least two pairs of opposed extremities (120*a*, 120*b*);

a first comfort plate (200) detachably coupled with said pair of opposed extremities (120*a*) of said back surface (120) thereby forming openings (O, O') towards other pair of opposed extremities (120*b*) and thereby configuring an enclosure, said first comfort plate (200) having at least one detachable massaging unit (210); and a second comfort plate (300) disposed within said enclosure such that a portion of said second comfort plate (300) extends through said first comfort plate (200) at said opposed extremities (120*b*), said second comfort plate (300) having at least one detachable massaging unit (310), a pair of straps (320), each of said straps (320) coupled with an upper portion of said second comfort plate (300) at one end and a bottom portion of said housing (100) at other end, at least one length adaptable member (330) coupled with a lower portion of said second comfort plate (300) and configured to control movement of said second comfort plate (300) along a longitudinal direction within said enclosure configured by the first comfort plate (200).

2. The adaptable backpack (1000) as claimed in claim 1, wherein said openings (O, O') together forms a continuous opening towards said other pair of opposed extremities (120*b*) of said back surface (120) which thereby forms said enclosure.

3. The adaptable backpack (1000) as claimed in claim 1, wherein said at least one detachable massaging units (210, 310) of said first comfort plate (200) and said second comfort plate (300) protrude outward from said back surface (120) of said housing (100).

4. The adaptable backpack (1000) as claimed in claim 1, wherein said at least one detachable massaging units (210, 310) of said first comfort plate (200) and said second comfort plate (300) are configured to operate simultaneously or independently.

5. The adaptable backpack (1000) as claimed in claim 1, wherein said at least one detachable massaging units (210, 310) of said first comfort plate (200) and said second comfort plate (300) are provided as an integrated structure coupled with said first comfort plate (200) and said second comfort plate (300), respectively.

6. The adaptable backpack (1000) as claimed in claim 1, wherein said first comfort plate (200) and said second comfort plate (300) are made up of ethylene-vinyl acetate (EVA) material.

7. The adaptable backpack (1000) as claimed in claim 1, further comprising a control unit (400) provided on at least one strap (320) of said second comfort plate (300) and configured to control operations of said at least one detachable massaging units (210, 310) of said first comfort plate (200) and said second comfort plate (300).

8. The adaptable backpack (1000) as claimed in claim 1, further comprising a detachable power unit (500) electrically connected to said at least one detachable massaging units (210, 310) of said first comfort plate (200) and said second comfort plate (300).

9. The adaptable backpack (1000) as claimed in claim 8, wherein said detachable power unit (500) comprises at least one replaceable battery disposed within said housing (100).

10. A method of adjusting at least one detachable massaging unit of an adaptable backpack (1000), the method comprising:

providing a housing (100) of said adaptable backpack (1000) having a front surface (110), a back surface (120), a pair of opposed side surfaces (130, 140), a top surface (150) and a bottom surface (160), said back surface (120) having at least two pairs of opposed extremities (120*a*, 120*b*);

detachably coupling a first comfort plate (200) with said pair of opposed extremities (120*a*) of said back surface (120) thereby forming openings (O, O') towards other pair of opposed extremities (120*b*) and thereby configuring an enclosure, said first comfort plate (200) having at least one detachable massaging unit (210);

inserting a second comfort plate (300) within said enclosure such that a portion of said second comfort plate (300) extends through said first comfort plate (200) at said opposed extremities (120*b*), said second comfort plate (300) having at least one detachable massaging unit (310), at least one length adaptable member (330) coupled with a lower portion of said second comfort plate (300); and controlling movement of said second comfort plate (300) along a longitudinal direction within said enclosure by said at least one length adaptable member (330) thereby adjusting placement of said at least one detachable massaging unit (310) of said second comfort plate (300) as per the height of a user.

11. The method as claimed in claim 10, wherein said openings (O, O') together forms a continuous opening towards said other pair of opposed extremities (120*b*) of said back surface (120) which thereby forms said enclosure.

* * * * *